US012144431B2

(12) United States Patent
Holwerda et al.

(10) Patent No.: US 12,144,431 B2
(45) Date of Patent: Nov. 19, 2024

(54) SEATING STRUCTURE

(71) Applicant: MillerKnoll, Inc., Zeeland, MI (US)

(72) Inventors: Christopher John Holwerda, Hudsonville, MI (US); William Douglas Allen, Fennville, MI (US)

(73) Assignee: MillerKnoll, Inc., Zeeland, MI (US)

( * ) Notice: Subject to any disclaimer, the term of this patent is extended or adjusted under 35 U.S.C. 154(b) by 65 days.

(21) Appl. No.: 18/103,602

(22) Filed: Jan. 31, 2023

(65) Prior Publication Data

US 2024/0251952 A1 Aug. 1, 2024

(51) Int. Cl.
*A47C 7/18* (2006.01)
*A47C 7/00* (2006.01)
*A47C 7/40* (2006.01)

(52) U.S. Cl.
CPC ..... *A47C 7/40* (2013.01); *A47C 7/004* (2013.01); *A47C 7/18* (2013.01)

(58) Field of Classification Search
CPC ..... A47C 7/18
USPC ..... 297/440.2
See application file for complete search history.

(56) References Cited

U.S. PATENT DOCUMENTS 338,537 A 3/1886 Mankel, Jr.
3,288,525 A 11/1966 Cerf
3,600,035 A * 8/1971 Vondrejs ..... A47C 7/18 297/452.59
3,669,499 A * 6/1972 Semplonius ..... A47C 5/06 297/440.2 X
3,851,920 A * 12/1974 Harris ..... A47C 7/18 297/440.22
4,099,774 A * 7/1978 Sandham ..... A47C 7/441 297/440.2 X
5,499,859 A 3/1996 Angell
6,135,562 A * 10/2000 Infanti ..... A47C 13/005 297/440.2 X
6,220,661 B1 4/2001 Peterson
7,338,116 B1 * 3/2008 Lin ..... A47C 4/24 297/46
7,490,392 B2 * 2/2009 Peterson ..... B29D 99/0092 29/91.1
8,157,322 B2 4/2012 Daisuke et al.
8,998,338 B2 * 4/2015 Vander Veen ..... A47C 7/462 297/452.59
9,538,849 B2 1/2017 Beyer et al.
10,264,890 B2 4/2019 Aldrich et al.
10,569,681 B1 * 2/2020 Sardo ..... B60N 2/686
(Continued)

FOREIGN PATENT DOCUMENTS

WO 9325121 A1 12/1993

OTHER PUBLICATIONS

International Search Report and Written Opinion for Application No. PCT/US2024/012963 dated Apr. 11, 2024 (12 pages).

*Primary Examiner* — Rodney B White
(74) *Attorney, Agent, or Firm* — Michael Best & Friedrich LLP

(57) ABSTRACT

A seating structure includes a base, a seat supported by the base, and a backrest supported by the base. The backrest includes a rear backrest section and a front backrest section coupled to the rear backrest section to define a gap therebetween. The gap extends around at least part of a perimeter of the backrest. The backrest further includes a fabric layer covering the front backrest section. A portion of the fabric layer is received in the gap.

19 Claims, 8 Drawing Sheets

(56) References Cited

U.S. PATENT DOCUMENTS

| | | | | |
|---|---|---|---|---|
| 10,813,463 | B2 | 10/2020 | Deevers et al. | |
| 10,893,752 | B2 | 1/2021 | Machael et al. | |
| 2007/0236073 | A1* | 10/2007 | Walters | A47C 7/18<br>297/452.32 |
| 2011/0272986 | A1 | 11/2011 | Iacovoni et al. | |
| 2014/0077553 | A1* | 3/2014 | Battey | A47C 7/24<br>297/301.4 |
| 2014/0077555 | A1* | 3/2014 | Battey | A47C 1/14<br>297/340 |
| 2014/0077557 | A1* | 3/2014 | Battey | A47C 1/024<br>297/340 |
| 2014/0077567 | A1* | 3/2014 | Battey | A47C 1/03272<br>297/411.36 |
| 2014/0319890 | A1* | 10/2014 | Rivera | A47C 7/467<br>297/452.41 |

* cited by examiner

SEATING STRUCTURE

FIELD OF THE INVENTION

The present invention relates to a seating structure, and in particular, to a seating structure, such as a chair.

SUMMARY

In one aspect, the invention provides, a seating structure including a base, a seat supported by the base, and a backrest supported by the base. The backrest includes a rear backrest section and a front backrest section coupled to the rear backrest section to define a gap therebetween. The gap extends around at least part of a perimeter of the backrest. The backrest further includes a fabric layer covering the front backrest section. A portion of the fabric layer is received in the gap.

In another aspect, the invention provides, a seating structure including a base, a seat supported by the base, and a backrest supported by the base. The backrest includes a rigid substrate having a front side, a rear side, and an edge. The backrest also includes a border element coupled to the front side of the rigid substrate. The border element extends outwardly beyond the edge of the rigid substrate to at least partially define a gap. The backrest further includes a front foam layer overlaying the border element and the front side of the rigid substrate and a fabric layer covering the front foam layer. A portion of the fabric layer is received in the gap.

In another aspect, the invention provides, a seating structure including a base, a seat supported by the base, and a backrest supported by the base. The backrest includes a rigid substrate having a front side, a rear side, and a perimeter edge defined between the front and rear sides. The backrest also includes a front backrest section coupled to the front side of the rigid substrate. A portion of the front backrest section extends outwardly beyond the perimeter edge of the rigid substrate. The backrest further includes a rear backrest section coupled to the rear side of the rigid substrate. A portion of the rear backrest section extends outwardly beyond the perimeter edge of the rigid substrate to define a gap between the front backrest section and the rear backrest section. The backrest also includes a fabric layer covering the front backrest section, the rear backrest sections, or both, wherein a portion of the fabric layer is received in the gap.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

To avoid crowding the drawings with reference numbers for different ends, sides, etc. of parts of the chair, it will be presumed that one of ordinary skill will read this disclosure with the ordinary meaning of directional and positional terms in mind. Throughout this disclosure, for example, the terms "left," "right," "rear," "front," "forward," and "rearward" are used from the perspective of an occupant or user seated in the chair. Terms such as "top" and "bottom" are used with respect to the intended ordinary condition of the chair. The term "above" means that one component is positioned higher than another with necessarily being in the same vertical plane. The term "vertically above" means that one component is higher than another thing and in the same vertical plane. "Below" means a component is lower than another component, whereas "vertically below" means that the component is lower and also within the same vertical plane as the other component.

DETAILED DESCRIPTION

Figure 1:
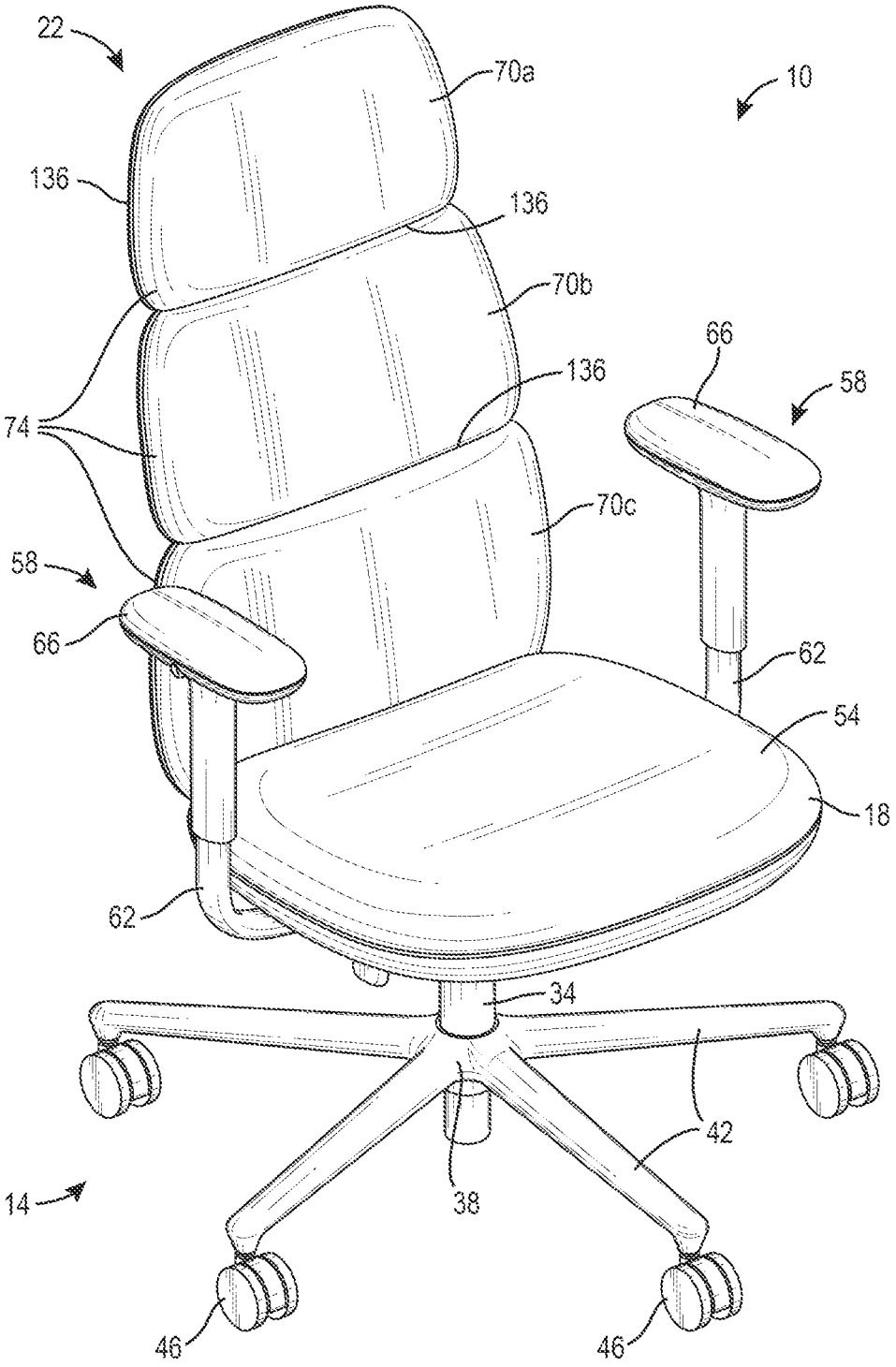
FIG. 1 is a front perspective view of a seating structure.
Figure 2:
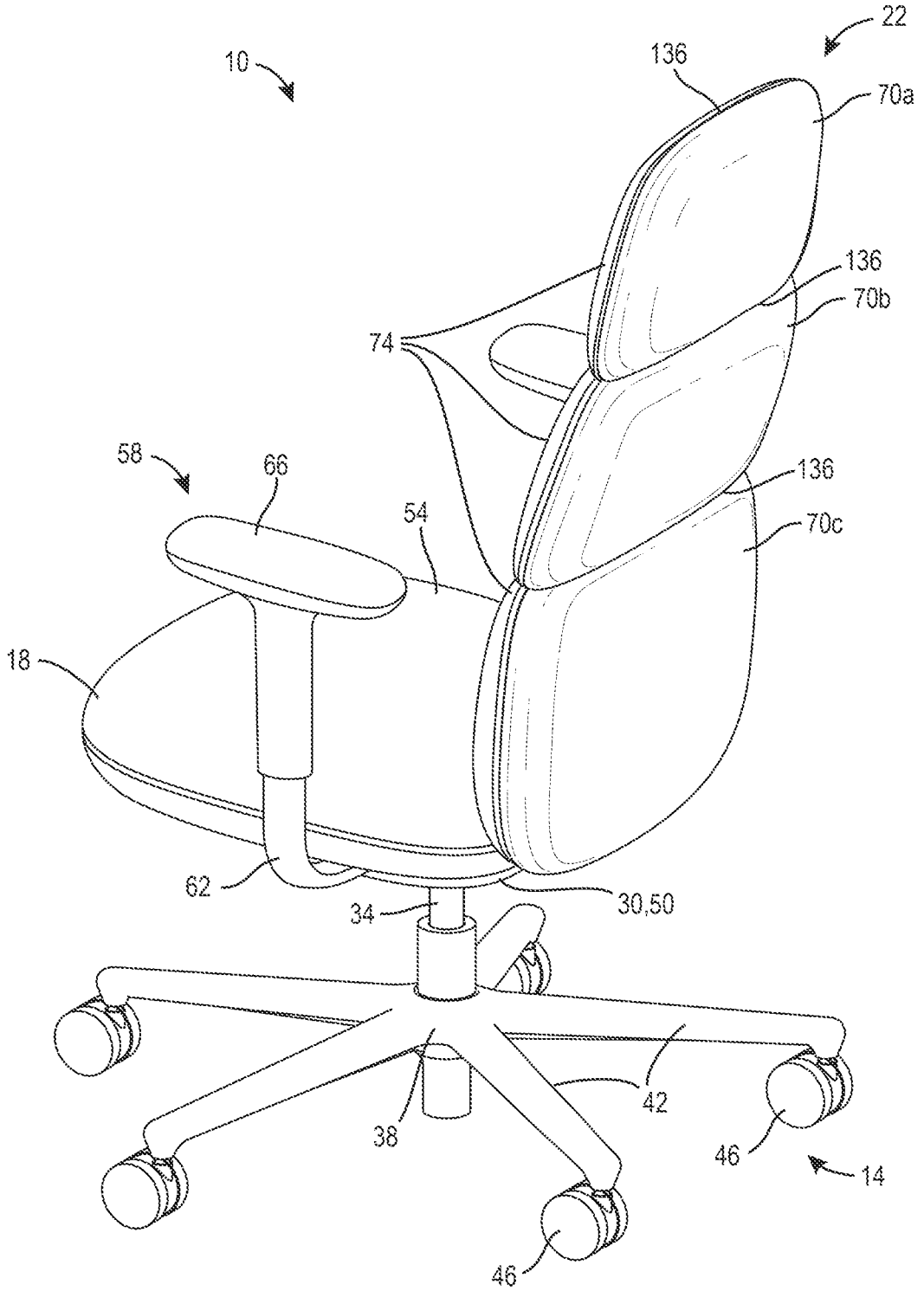
FIG. 2 is a rear perspective view of the seating structure of FIG. 1.

FIGS. 1 and 2 illustrate a seating structure 10, such as a chair. The seating structure 10 may also be referred to as a task chair or office chair. Although the seating structure 10 is shown as a chair, the seating structure 10 may take other forms, such as a stool, a couch, a bench, a settee, and the like. The illustrated seating structure 10 includes a base 14, a seat 18, and a backrest 22. Various aspects of the seating structure 10 may be adjustable to fit different sizes or preferences of users. In addition, the seating structure 10 may have different aesthetics than those shown in the drawings, which are simply included as exemplary.

The illustrated base 14 includes a tilt mechanism 30 (FIG. 2), a support column 34 coupled to and supporting the tilt mechanism 30, and a base structure 38 coupled to and supporting the support column 34. The base structure 38 includes a plurality of feet 42 that extend outward from a center portion of the base structure 38. In the illustrated embodiment, each of the feet 42 supports a caster or wheel 46 that allows the seating structure 10 to move along a surface. In other embodiments, the base structure 38 may not include the wheels 46. The base structure 38 is rotatable about the support column 34. In other words, the seat 18 and the backrest 22 are rotatable about the base 14 in order to change the facing direction of a user sitting in the seating structure 10 relative to the base structure 38. The support column 34 is also vertically adjustable. In the illustrated embodiment, the support column 34 includes a plurality of telescoping tubes that move to adjust the height of the seat 18. In some embodiments, the support column 34 may be powered by a pneumatic system that drives movement of the telescoping tubes. Further, the support column 34 may be adjusted using an adjustment member that controls operation of the pneumatic system. In other embodiments, the seating structure 10 may include other types of bases. For example, the seating structure 10 may include a base having four stationary legs, or the seating structure 10 may include a base suitable for stool or counter height.

The seat 18 is coupled to the tilt mechanism 30 above the support column 34. The illustrated seat 18 includes a skirt 50 and a cushion 54 supported by the skirt 50. In the illustrated embodiment, the cushion 54 is a foam cushion covered by a fabric or textile material. In other embodiments, the seat 18 may include suspension material instead of the cushion 54 to support a user. In addition, the seat 18 may have various shapes and forms to provide different aesthetic appearances of the seating structure 10.

The seating structure 10 also includes a pair of armrests 58. The illustrated armrests 58 are coupled to the seat 18. In other embodiments, the armrests 58 may be coupled to other portions of the seating structure 10. In the illustrated embodiments, the armrests 58 are disposed over side uprights 62 so that the side uprights 62 are received within a cavity of the armrests 58. The side uprights 62 extend from the skirt 50 of the seat 18. Each armrest 58 includes an arm support 66 that may include a foam padding to provide cushion to a user's arms when sitting in the seating structure 10. In various embodiments, the armrests 58 are vertically adjustable, by way of the armrests 58 moving relative to the side uprights 62. The armrests 58 may have various shapes and forms to provide different aesthetic appearances of the seating structure 10. The armrests 58 may also be omitted from the seating structure 10.

Figure 7:
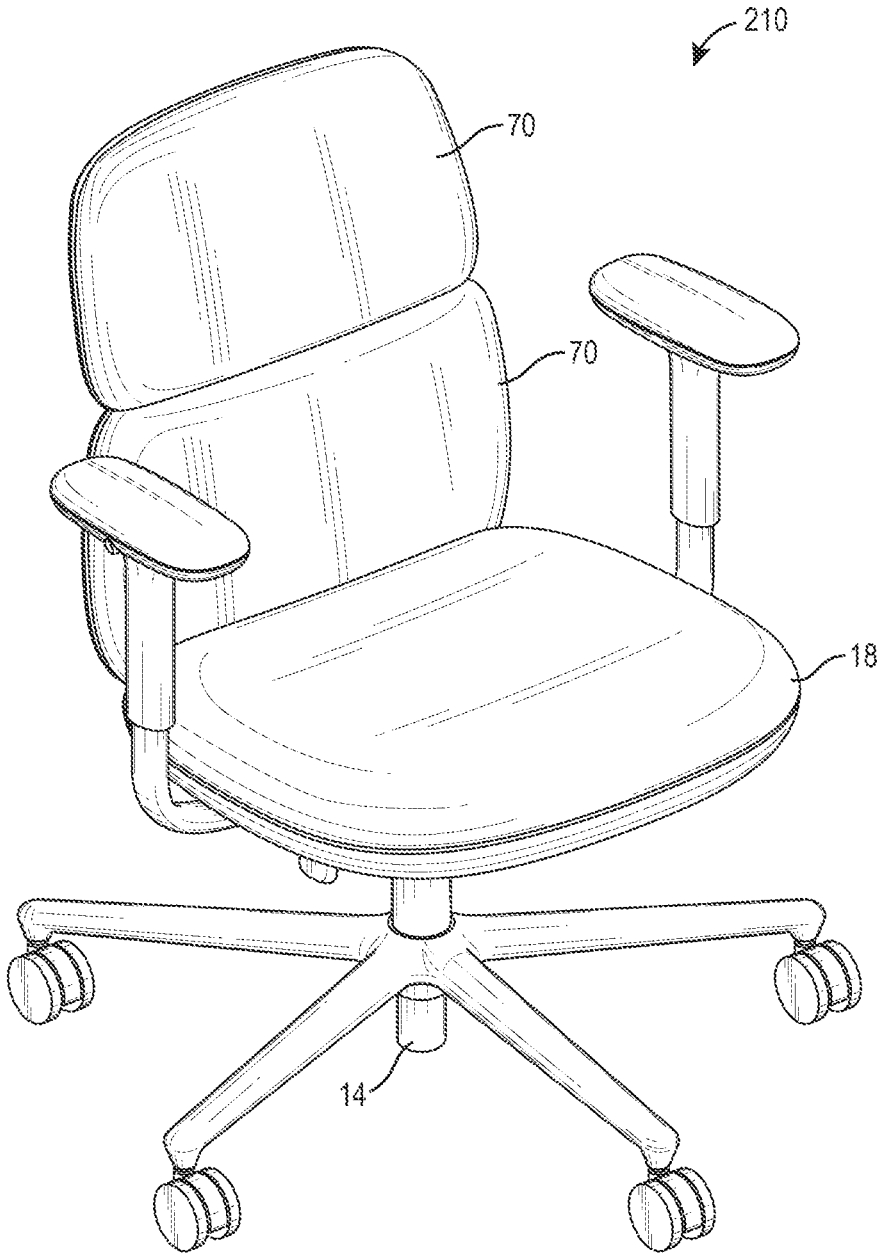
FIG. 7 is a front perspective view of a chair according to another embodiment of the invention.

The backrest 22 is coupled to the skirt 50 through a bracket (not shown) extending from the skirt 50. The backrest 22 includes a plurality of backrest segments 70. In the illustrated embodiment, the backrest 22 includes three backrest segments (i.e., a top or first segment 70*a*, a middle or second segment 70*b*, and a bottom or third segment 70*c*). In other embodiments, the backrest 22 may include more than three backrest segment 70, or less than three backrest segments 70, such as the seating 210 structure shown in FIG. 7 or only a single backrest segment 70. Each backrest segment 70 includes a front section 74 (FIG. 1) and a rear section 78 (FIG. 2) opposite the front section 74.

Figure 3:
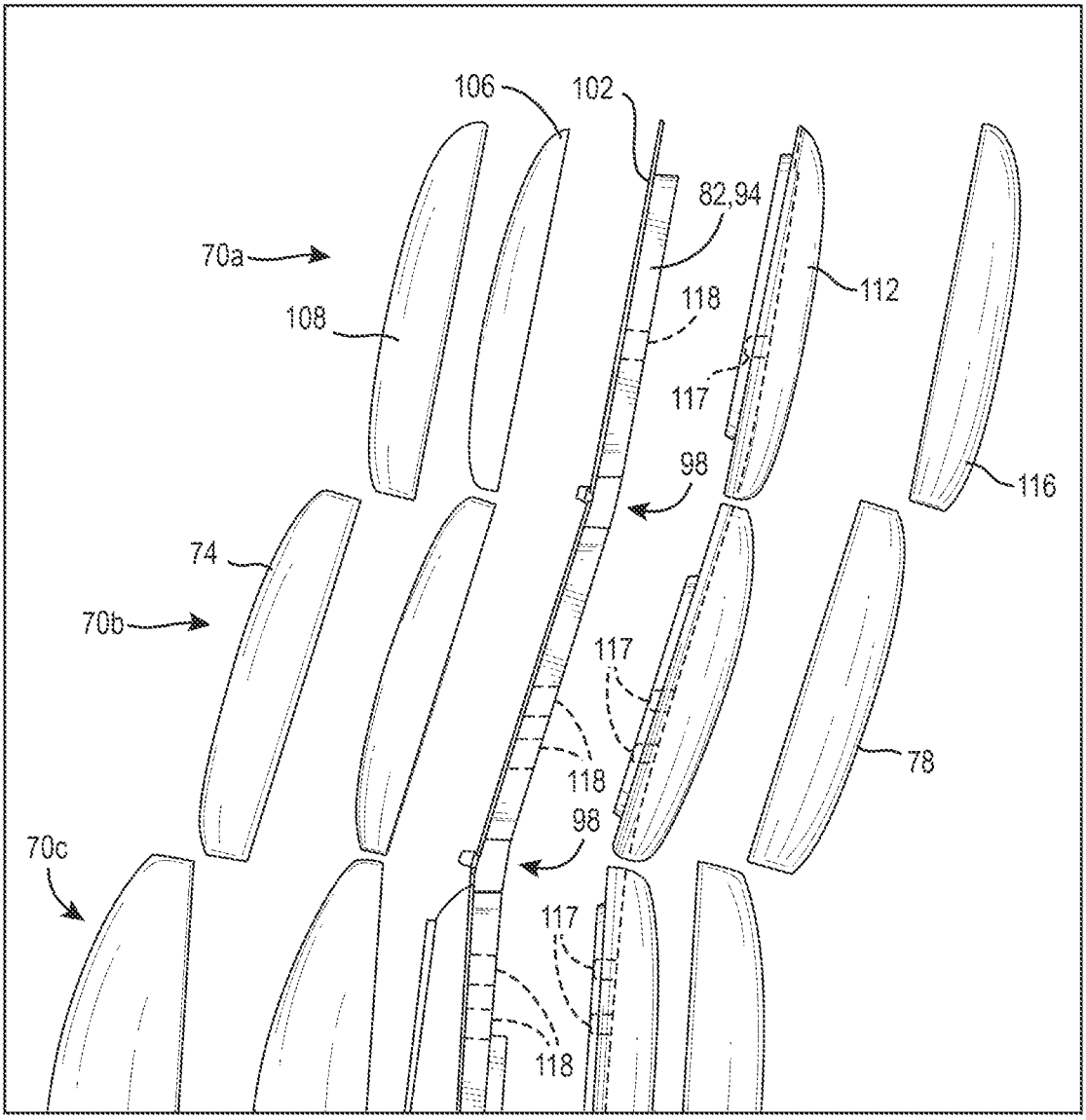
FIG. 3 is an exploded side view of a backrest of the chair of FIG. 1.
Figure 4A:
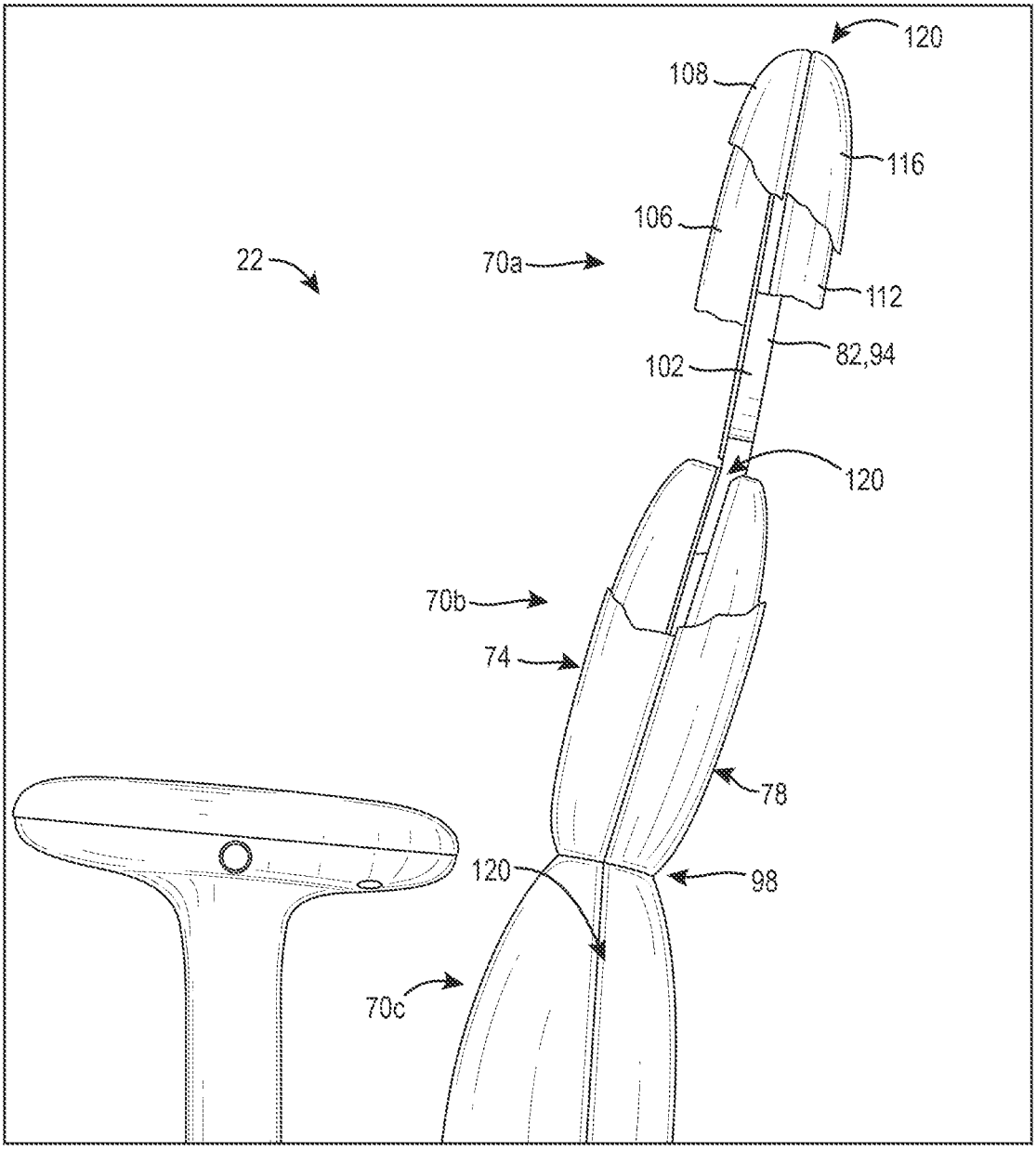
FIG. 4A is a breakaway side view of the backrest of the chair of FIG. 3.
Figure 4B:
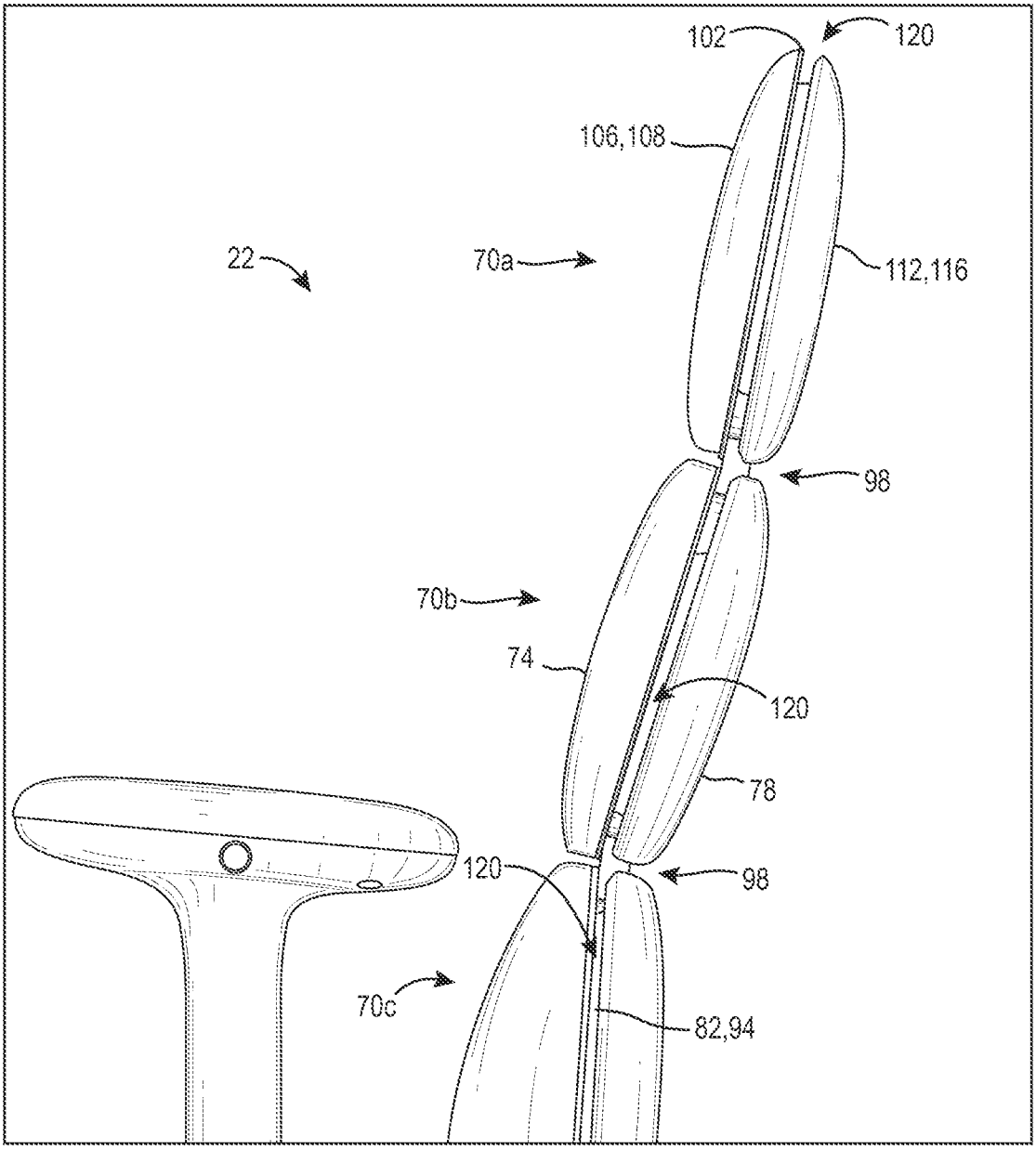
FIG. 4B is a side view of the backrest of the chair of FIG. 1 with a fabric layer removed.

With reference to FIGS. 3, 4A, and 4B, the backrest 22 further includes a rigid substrate 82 positioned between the front sections 74 and the rear sections 78. The rigid substrate 82 is a formed piece that may be made from plywood, high density plastic, or the like. In the illustrated embodiment, the rigid substrate 82 extends continuously over each of the backrest segments 70. In other words, the rigid substrate 82 is positioned between the front and rear sections 74, 78 of each of the backrest segments 70. In other embodiments, each backrest segment 70 may include an individual (i.e., separate) rigid substrate 82 that couples to the other rigid substrates 82. The rigid substrate 82 includes a front side 86, a rear side 90 opposite the front side 86, and a perimeter edge 94 defined between the front and rear sides 86, 90. The rigid substrate 82 includes recesses 98 (FIGS. 5 and 6) defining a boundary between each of the backrest segments 70. The front section 74 of each backrest segment 70 is coupled to the front side 86 of the rigid substrate 82. Conversely, the rear section 78 of each backrest segment 70 is coupled to the rear side 90 of the rigid substrate 82.

The front section 74 of each backrest segment 70 includes the rigid substrate 82, a border element 102, a first foam layer 106, and a first fabric layer 108. The rear section 78 of each backrest segment 70 includes the rigid substrate 82, a second foam layer 112, and a second fabric layer 116. The rigid substrate 82 may be considered part of either the front section 74 or the rear section 78 of the backrest 22 or as a separate component from the front and rear sections 74, 78.

Figure 5:
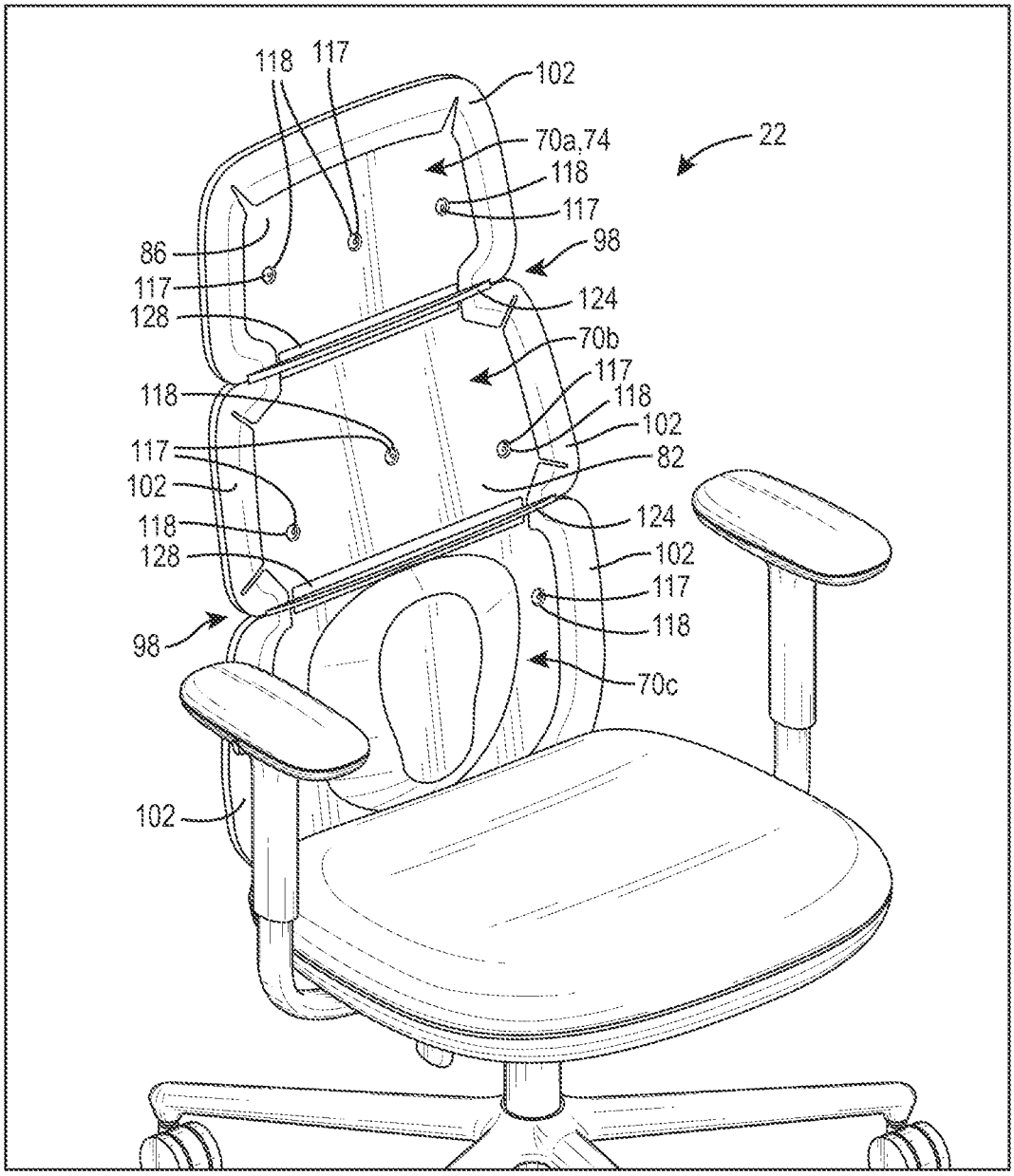
FIG. 5 is a front perspective view of the chair of FIG. 1 with portions removed.

With reference to FIG. 5, the front section 74 of the top segment 70*a* of the backrest 22 includes a single border element 102 extending around the perimeter of rigid substrate 82. In other words, the border element 102 surrounds three sides of the rigid substrate 82. The front sections 74 of the middle and bottom segment 70*b*, 70*c* of the backrest 22 include two separate border elements 102, on opposite sides of the rigid substrate 82, extending along the perimeter thereof. In each of the front sections 74 of the backrest segments 70, the border element 102 is coupled to the front side 86 of the rigid substrate 82. The border element 102 may be coupled to the rigid substrate 82 with fasteners, adhesives, or the like. The illustrated border elements 102 are relatively thin, plate-like members. The border elements 102 may be made of a relatively rigid material, such as plastic, wood, metal, and the like. The border elements 102 are coupled to the rigid substrate 82 so that portions of the border elements 102 extend outwardly beyond the perimeter edge 94 of the rigid substrate 82. In the illustrated embodiment, the portions of the border elements 102 extend past the perimeter edge 94 a distance that is approximately ½". In other embodiments, the portions of the border elements 102 may extend past the perimeter edge 94 a distance between ⅛" and 1".

Figure 6:
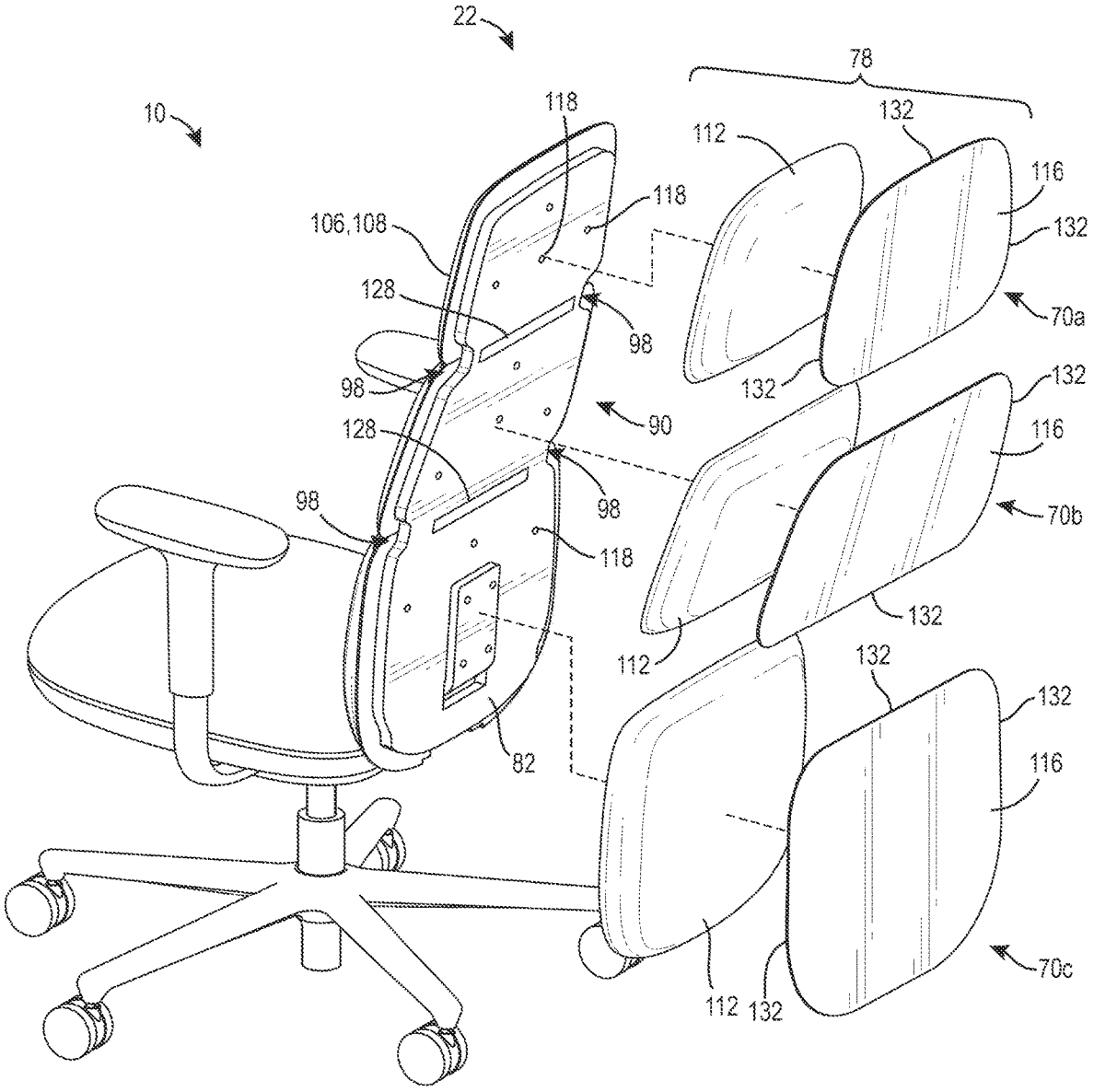
FIG. 6 is a rear, partially exploded perspective view of the chair of FIG. 1.

With continued reference to FIG. 5, the backrest 22 includes a first profile strip 124 extending between the recesses 98 on the front side 86 of the rigid substrate 82 to divide the first segment 70*a* from the second segment 70*b*. Similarly, a second profile strip 124 extends between the recesses 98 on the front side 86 of the rigid substrate 82 to separate the second segment 70*b* from the third segment 70*c*. In some embodiments, the backrest 22 may include additional profile strips 124 on the rear side 90 of the rigid substrate 82. The profile strips 124 help align each of the first foam layers 106 when the first foam layers 106 are coupled to the rigid substrate 82. The profile strips 124 also partially separate the first fabric layers 108 from the front side 86 of the rigid substrate 82 as will be discussed in more detail below. A hook and loop strip 128 is positioned along the length of the profile strips 124 to receive a hook and loop strip (not shown) positioned on the inside of the fabric layers 108, 116. Additionally, as shown in FIG. 6, the rear side 90 of the rigid substrate 82 also includes hook and loop strips 128 to divide the backrest segments 70.

With reference back to FIGS. 3, 4A, and 4B, the first foam layer 106 of each backrest segment 70 is coupled to the border element 102 and the front side 86 of the rigid substrate 82 using fasteners, adhesive, or the like. Specifically, the first foam layer 106 includes projections 117 that are received in locating holes 118 (FIG. 5) on the front side 86 of the rigid substrate 82. The locating holes 118 support and position the first foam layer 112. The first foam layer 106 is coupled to the border element 102 so that the outer perimeter aligns with the outer perimeter of the border element 102. As such, a portion of the first foam layer 106 also extends past the perimeter edge 94 of the rigid substrate 82. The border elements 102, thereby, provide support for portions of the first foam layer 106 that extend beyond and are not directly supported by the rigid substrate 82. In the illustrated embodiment, the portion of the first foam layer 106 extends past the perimeter edge 94 a distance that is approximately ½". In other embodiments, the portion of the first foam layer 106 may extend past the perimeter edge 94 a distance between an ⅛" and 1". In the illustrated embodiment, each front section 74 of the backrest segment 70 includes a separate first foam layer 106. In other embodiments, the backrest 22 may include a single first foam layer 106 that extends continuously between the front sections 74 of the backrest segments 70.

The second foam layer 112 of each backrest segment 70 is coupled to the rear side 90 of the rigid substrate 82 using fasteners, adhesives, or the like. Specifically, the second foam layer 112 includes projections 117 that are received in locating holes 118 (FIG. 6) on the rear side 90 of the rigid substrate 82. The locating holes 118 support and position the second foam layer 112. The second foam layer 112 is coupled to the rigid substrate 82 so that a portion of the second foam layer 112 extends outwardly beyond the perimeter edge 94 of the rigid substrate 82. In the illustrated embodiment, second foam layer 112 extends outwardly beyond the perimeter edge 94 of the rigid substrate 82 approximately the same distance that the border element 102 extend outwardly beyond the perimeter edge 94. For example, the portion of the second foam layer 112 extends past the perimeter edge 94 a distance that is approximately ½". In other embodiments, the portion of the second foam layer 112 may extend past the perimeter edge 94 a distance between ⅛" and 1". In further embodiments, the second foam layer 112 may extend or wrap around the perimeter edge 94 of the rigid substrate 82. In the illustrated embodiment, each rear section 78 of the backrest segments 70 includes a separate second foam layer 112. In other embodiments, the backrest 22 may include a second foam layer 112 that extends continuously between the rear sections 78 of the backrest segments 70.

In the illustrated embodiment, the first foam layer 106 is a softer foam, while the second foam layer 112 is a more rigid foam. For example, the first foam layer 106 is made of polyurethane (PU), and the second foam layer 112 may be made from expanded polypropylene (EPP). As such, the first foam layer 106 is softer than the second foam layer 112. In some embodiments, the first and second foam layers 106, 112 may be made from the same material and have the same softness. In other embodiments, the first and second foam layers 106, 112 may be made from other materials. In some embodiments, the second foam layer 112 may be made of a non-foam material. For example, the second foam layer 112 may be replaced by a body having the desired shape and contour, but made of a different material (e.g., wood, blow molded plastic, etc.).

In the illustrated embodiment, the first and second fabric layers 108, 116 are a knit material, such as a 3D knit fabric. In other embodiments, the first and second fabric layers 108, 116 may be a woven material. In other embodiments, the first and second fabric layers 108, 116 may be a different arrangement or formed of different materials or combinations of materials. Further, the first and second fabric layers 108, 116 may be made from the same material. Alternatively, the first and second fabric layers 108, 116 may be made from different materials. The first and second fabric layers 108, 116 may include a variety of patterns, colors, styles, or images that improve the aesthetics of the seating structure 10. In the illustrated embodiment, edges 132 (FIG. 6) of the first and second fabric layers 108, 116 are sewn together to form a seam 136 (FIGS. 1 and 2). Specifically, the edges 132 are sewn together to form a single pillow-case like structure with an opening that can be slid over the rigid substrate 82, the first and second foam layers 106, 112, and the first and second fabric layers 108, 116. As described above, a hook and loop strip 128 may be placed on the inside of the horizontal seams 136 to help secure the fabric layers 108, 116 on the rigid substrate 82 when the backrest 22 is assembled as described in more detail below. In further embodiments, a single first fabric layer 108 may be used for all of the front sections 74 of the backrest 22 and a single piece of second fabric layer 116 may be used for all of the rear sections 78 of the backrest 22. In alternative embodiments, a separate first fabric layer 108 may be used for each backrest segment 70 on the front section 74 of the backrest 22 and a separate second fabric layer 116 may be used for each backrest segment 70 on the rear section 78 of the backrest 22. The first fabric layer 108 is coupled to the front side 86 of the rigid substrate 82 to cover the first foam layer 106 and the border element 102, as will be described in more detail below. The second fabric layer 116 is coupled to the rear side 90 of the rigid substrate 82 to cover the second foam layer 112, as will be describe in more detail below. The first and second fabric layers 108, 116 may also be coupled (e.g., sewn, knitted, glued, etc.) together.

Together, the components of the front section 74 (i.e., the border element 102 and the first foam layer 106) of each backrest segment 70 that extend outwardly from the perimeter edge 94 of the rigid substrate 82 and the components of the rear section 78 (i.e., second foam layer 112) of each backrest segments 70 that extend outwardly from the perimeter edge 94 of the rigid substrate 82 define a gap 120 (FIG. 4B) therebetween. The gap 120 extends around the perimeter edge 94 of the rigid substrate 82 between the backrest segments 70. The recesses 98 of the rigid substrate 82 partially define the gap 120 between adjacent backrest segments 70. In the illustrated embodiment, the gap 120 is defined by a distance between the rear sections 78 and the front sections 74 of the backrest 22. The distance is between 0.125 inches and 0.5 inches. In other embodiments, the distance may be less than 0.125 inches or more than 0.5 inches. The gap 120 extends around a majority of the perimeter edge 94 of the rigid substrate 82. In other words, the gap 120 extends around at least 50% of the perimeter of the rigid substrate 82.

When assembling the seating structure 10, the gap 120 provides a relief for the outside seams 136 of the first and second fabric layers 108, 116 to be tucked into around the perimeter edge 94 of the rigid substrate 82. In other words, when the first and second fabric layers 108 are being positioned over the backrest 22, the outside seams 136 formed by the first and second fabric layers 108, 116 are tucked into the gap 120 or recesses 98. The edges 132 of the first and second fabric layers 108, 116 may be tucked simultaneously or together (e.g., when the edges 132 of the fabric layers 108, 116 are coupled together), or may be tucked independently of each other. In some embodiments, a tool may be used to help push the edges 132 of the fabric layers 108, 116 into the gap 120. Further, as the first and second fabric layers 108, 116 are tucked into the recesses 98, the hook and loop strips 128 on the inside seams 136 of the first and second fabric layers 108, 116 are coupled to the hook and loop strips 128 on both the front side 86 and the rear side 90 of the rigid substrate 82. Specifically, the hook and loop strips 128 on the horizontal, inside seams 136 of the first fabric layer 108 are coupled to the hook and loop strips 128 on the profile strips 124. The profile strips 124 distance the first fabric layer 108 away from the front side 86 of the rigid substrate 82 to allow the hook and loop strips 128 to couple together. Tucking the edges 132 of the first and second fabric layers 108, 116 helps tighten the fabric layers 108, 116 to reduce wrinkles on the surfaces of the fabric layers 108, 116. The edges 132 of the fabric layers 108, 116 may be held within the gap 120 simply by friction. In some embodiments, the edges 132 of the fabric layers 108, 116 may also be secured within the gap 120 using fasteners, adhesives, or other suitable means known in the art.

Providing the border elements 102 on the front section 74 of the backrest 22 helps maintain the shape of the backrest 22 when using a softer foam layer such as polyurethane foam (i.e., the first foam layer 106). In addition, the border element 102 helps maintain the rigidity of the first foam layer 106 to keep it from deteriorating over time. Further, the border element 102 assists in creating the gap 120 between the front and rear sections 74, 78 of the backrest 22. The gap 120 provides a relief to any additional fabric not required to cover the front or rear sections 74, 78 of the backrest 22. As such, the gap 120 facilitates easier assembling of the seating structure 10 by not requiring a fitted fabric layer for each different section. In some embodiments, the seat 18 may be designed similar to the backrest 22. Specifically, the seat 18 may include a rigid substrate, a top section, a bottom section and a gap defined therebetween to receive a fabric layer.

Various features and advantages are set forth in the following claims.

What is claimed is:

1. A seating structure comprising:

a base;

a seat supported by the base; and a backrest supported by the base, the backrest including a rear backrest section, a front backrest section coupled to the rear backrest section to define a gap therebetween, the gap extending around at least part of a perimeter of the backrest, and a fabric layer covering the front backrest section, wherein a portion of the fabric layer is received in the gap;

wherein the rear backrest section includes a rigid substrate and a first foam layer coupled to a first side of the rigid substrate, and wherein the front backrest section includes a border element and a second foam layer coupled to a second side of the rigid substrate.

2. The seating structure of claim 1, wherein both the first foam layer and the border element extend beyond an edge of the rigid substrate such that the gap is formed between the first foam layer and the border element.

3. The seating structure of claim 1, wherein the second foam layer is softer than the first foam layer.

4. The seating structure of claim 3, wherein the first foam layer is expanded polypropylene and the second foam layer is polyurethane.

5. The seating structure of claim 1, wherein the backrest further includes a second fabric layer covering the rear backrest section, and wherein a portion of the second fabric layer is received in the gap.

6. The seating structure of claim 1, wherein the gap defines a distance between the front backrest section and the front backrest section, and wherein the distance is within a range between 0.125 inches and 0.5 inches.

7. A seating structure comprising:

a base;

a seat supported by the base; and a backrest supported by the base, the backrest including a rigid substrate having a front side, a rear side, and an edge, a border element coupled to the front side of the rigid substrate, the border element extending outwardly beyond the edge of the rigid substrate to at least partially define a gap, a front foam layer overlaying the border element and the front side of the rigid substrate, and a fabric layer covering the front foam layer, wherein a portion of the fabric layer is received in the gap.

8. The seating structure of claim 7, wherein the backrest further includes a rear foam layer overlaying the rear side of the rigid substrate.

9. The seating structure of claim 8, wherein the gap is defined between the border element and the rear foam layer.

10. The seating structure of claim 8, wherein the front foam layer is softer than the rear foam layer.

11. The seating structure of claim 8, wherein the backrest further comprises a second fabric layer covering the rear foam layer, and wherein a portion of the second fabric layer is received in the gap.

12. The seating structure of claim 7, wherein the border element extends outwardly beyond the edge of the rigid substrate a distance that is in a range between 0.25 inches 0.5 inches.

13. The seating structure of claim 7, wherein the gap extends around a majority of the edge of the rigid substrate.

14. A seating structure comprising:

a base;

a seat supported by the base; and a backrest supported by the base, the backrest including a rigid substrate having a front side, a rear side, and a perimeter edge defined between the front and rear sides, a front backrest section coupled to the front side of the rigid substrate, a portion of the front backrest section extending outwardly beyond the perimeter edge of the rigid substrate, a rear backrest section coupled to the rear side of the rigid substrate, a portion of the rear backrest section extending outwardly beyond the perimeter edge of the rigid substrate to define a gap between the front backrest section and the rear backrest section, and a fabric layer covering the front backrest section, the rear backrest sections, or both, wherein a portion of the fabric layer is received in the gap.

15. The seating structure of claim 14, wherein the backrest includes a plurality of segments, wherein the front backrest section is a first front backrest section coupled to the front side of the rigid substrate at a first segment of the plurality of segments, and wherein the rear backrest section is a first rear backrest section coupled to the rear side of the rigid substrate at the first segment, and wherein the backrest further includes a second front backrest section coupled to the front side of the rigid substrate at a second segment of the plurality of segments, a portion of the second front backrest section extending outwardly beyond the perimeter edge of the rigid substrate, and a second rear backrest section coupled to the rear side of the rigid substrate at the second segment, a portion of the second rear backrest section extending outwardly beyond the perimeter edge of the rigid substrate to define a gap between the second front backrest section and the second rear backrest section.

16. The seating structure of claim 15, wherein the rigid substrate extends continuously between the plurality of segments.

17. The seating structure of claim 14, wherein the front backrest section includes a border element and a first foam layer.

18. The seating structure of claim 17, wherein the rear backrest section includes a second foam layer.

19. The seating structure of claim 18, wherein the first foam layer is softer than the second foam layer.

* * * * *